United States Patent [19]

Pennec

[11] 4,188,684

[45] Feb. 19, 1980

[54] APPARATUS FOR ARTICULATION OF MOVABLE PANELS

[75] Inventor: Jean C. Pennec, Trappes, France

[73] Assignee: Regie Nationale des Usines Renault, Boulogne-Billancourt, France

[21] Appl. No.: 920,966

[22] Filed: Jun. 30, 1978

[30] Foreign Application Priority Data

Jun. 30, 1977 [FR] France ..... 77 20081

[51] Int. Cl.[2] ..... E05D 1/00

[52] U.S. Cl. ..... 16/128.1

[58] Field of Search ..... 16/128.1, 139, 144, 16/141, 128 R; 292/270, 278; 180/69 R, 69 C

[56] References Cited

U.S. PATENT DOCUMENTS

| | | | |
|---|---|---|---|
| 2,974,354 | 3/1961 | Matuzas | 16/144 X |
| 3,688,342 | 9/1972 | Little | 16/144 |
| 4,069,550 | 1/1978 | Silk et al. | 16/128.1 X |

FOREIGN PATENT DOCUMENTS

| | | | |
|---|---|---|---|
| 1181082 | 11/1964 | Fed. Rep. of Germany | 16/128.1 |
| 2320407 | 3/1977 | France . | |
| 667724 | 9/1964 | Italy | 16/128.1 |
| 948143 | 1/1964 | United Kingdom | 16/128.1 |
| 988380 | 4/1965 | United Kingdom . | |

*Primary Examiner*—Werner H. Schroeder
*Assistant Examiner*—Moshe I. Cohen
*Attorney, Agent, or Firm*—Oblon, Fisher, Spivak, McClelland & Maier

[57] ABSTRACT

An improved apparatus for the articulation of automobile trunk lids. The apparatus consists of a first link attached to the lid having a gooseneck shape and an elongate slot, a second link pivotable between one end of the first link and the trunk body, a pin connected to the trunk body and slidable within the elongate slot, a latch pivotable at one end to the first and second links and having a head which latches upon the pin when the lid is opened, and a torsion bar slidable along a cam surface of the latch, which biases the latch and links towards the lid open position. Since the latch holds the lid in place when it is fully open, the torsion bar may be weaker and thereby have a more optimum torque curve.

3 Claims, 3 Drawing Figures

APPARATUS FOR ARTICULATION OF MOVABLE PANELS

BACKGROUND OF THE INVENTION

1. Field of the Invention

The present invention is an improvement of the apparatus shown in French patent application No. 75/24807 filed Aug. 8, 1975 and relates to an apparatus for articulation of movable panels about a horizontal axis, the arrangement mounted entirely inside an automobile trunk.

2. Description of the Prior Art

In the aforementioned patent, the articulation apparatus is characterized by the fact that it consists of an element in the form of a gooseneck articulated, at one of its ends, with a link mounted so as to pivot about an axis integral with a fixed part of the trunk. The gooseneck has an elongated slot, acting as a cam, cooperating with a guide pin integral with the fixed part of the trunk, thus permitting suitable guiding of the gooseneck during manipulation of the trunk lid.

In the example illustrated, the equilibrating or compensating arrangement for the lid is realized on each side by a torsion bar resting on, and guided directly by, a roller integral with the articulation between the link and the gooseneck.

Therefore, the action of the torsion bar is applied at a well-defined point, integral with the articulation, which determines simultaneously the curve of equilibration in the course of lid motion and its maintenance in the open position.

However, this solution does not offer the desired equilibration curve and, besides, reliable holding of the lid in the open position is conditoned on the overestimation of the capacity of the torsion bars, which entails the provision of an adjustment for modifying their initial tension.

SUMMARY OF THE INVENTION

An object of the present invention is to avoid the above drawbacks, and particularly to seek a better adapted equilibration curve. Another object is to hold the lid in the full-open position by a positive and complete latching in order to eliminate the need for overequilibration.

To this end, the improvement consists of replacing the supporting and guiding roller for the torsion bar by a catch mounted so as to pivot on the axis of articulation of the link with the gooseneck. The upper edge of the catch has a recess in which the torsion bar is engaged so that it may follow the special cam-like profile of this recess during manipulation of the lid.

There results an equilibrating torque transmitted to the lid by the ensemble of articulations of the arrangement and a torque tending constantly to pivot the head of the catch towards the gooseneck so as to latch the head on a fixed pin integral with the trunk which also serves to guide the elongated slot of the gooseneck.

This action of the catch permits a relatively reduced effort on the part of the torsion bar, thus permitting a decrease in the torsion formerly necessary for holding the lid open. Consequently, the manipulation becomes smoother and, moreover, permits holding the lid in a more open position.

BRIEF DESCRIPTION OF THE DRAWINGS

Various other objects and many of the attendant advantages of the present invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Figure 1:
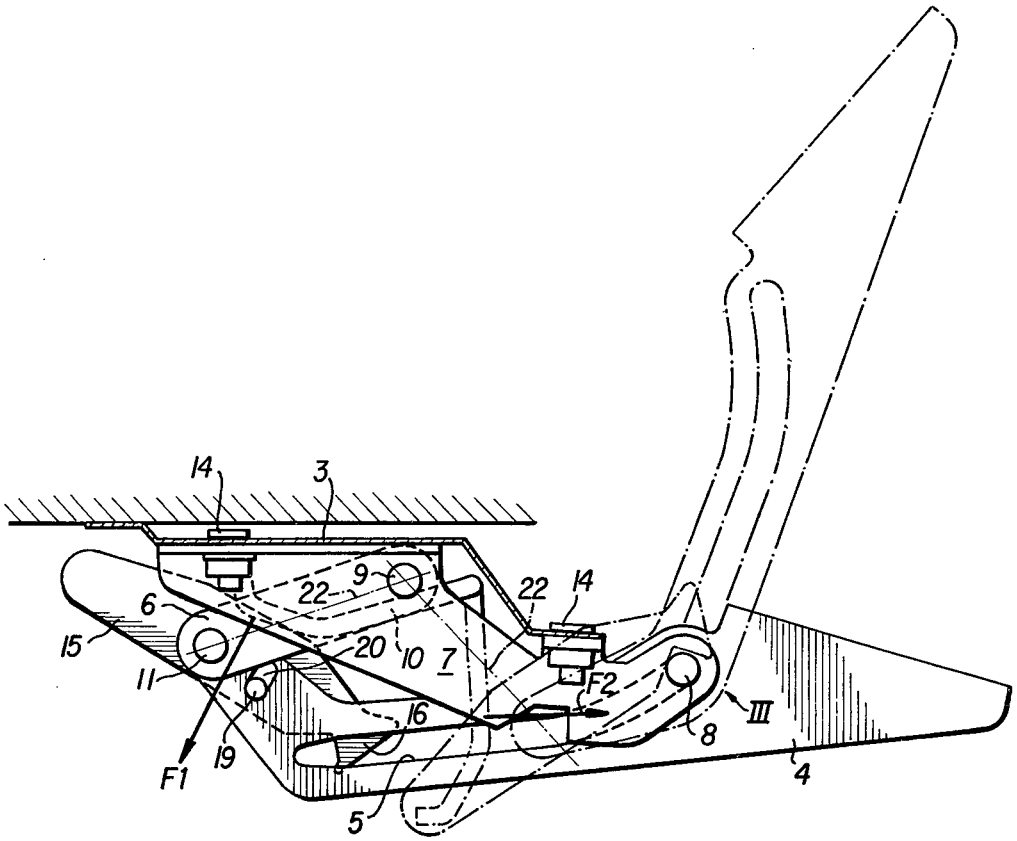
FIG. 1 is a side view of the articulating arrangement in its two extreme positions (dashed, lid open)

Adopting the same reference numbers as those used in the aforementioned patent to designate identical elements, the articulating arrangement according to the present FIG. 1 consists of gooseneck-shaped element 4, integral with the lid to be manipulated (not shown), the displacement of which is guided with respect to a fixed support 7 fastened to the trunk 3 by means of the bolts 14.

For this purpose the gooseneck 4 has an elongate slot 5 in the form of a cam traversed by a guide pin 8 integral with the support 7.

In the course of manipulating the lid, the gooseneck pivots with respect to the support 7 by the intermediary of a link 6 articulated on the one hand about an axis 9 integral with the trunk and on the other about an axis 11 integral with one end of the gooseneck 4.

The articulating ensemble, constituted by the arrangement described above, is associated with an equilibrating or compensating arrangement for the lid represented here by a set of torsion bars 10.

In conformance with the essential characteristic of the improvement, the end of the torsion bar presses on a flat piece in the form of a catch 15 mounted so as to pivot, essentially at its middle, on the common axis 11 of articulation of the link 6 with the gooseneck 4. This piece 15 will preferably be made of molded plastic.

Figure 2:
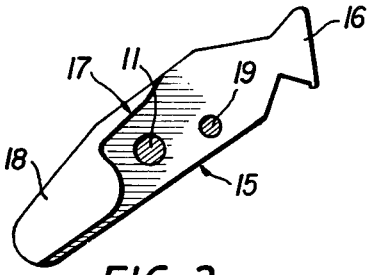
FIG. 2 shows, in cross section, the catch which constitutes the improvement of the invention.
Figure 3:
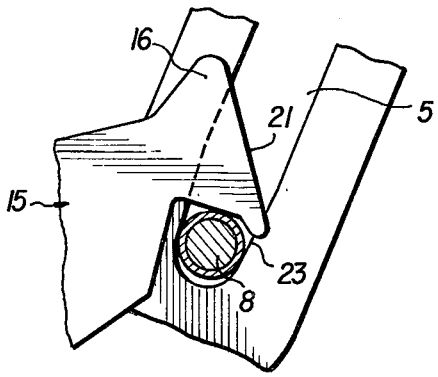
FIG. 3 is an enlarged view of the zone III of FIG. 1 showing the latching of the head of the catch on the guide pin.

The catch 15 is composed of these parts:

a head 16 intended to latch onto the guide pin 8 of the support (FIG. 3), to assure positive holding of the lid in the full-open position (shown dashed, FIG. 1).

a recess 17 in the form of a cam made in the upper edge of the catch, serving to support and guide the torsion bar 10, the profile of which is suited to the desired equilibration curve (FIG. 2).

a deeper cavity 18 within the catch 15 which is an extension to the rear of the preceding recess 17, serving to accommodate and shield the end of the torsion bar 10 when the lid is open (FIG. 2).

The catch is provided, moreover, with a projection 19 situated between its axis 11 and its head 16 engaging a concentric slot 20 in the gooseneck 4 in order to limit the swing of the hook about its axis.

The apparatus works as follows:

In the solid-line position in FIG. 1 (lid closed), the torsion bar 10 exerts a force $F_1$ on the recess of the catch which creates an equilibrating torque transmitted by the ensemble of different articulations of the arrangement and which causes the catch 15 to pivot about the axis 11 and holds it at the end of its travel as determined by the projection 19 engaging the slot 20.

During opening of the lid, the catch 15 stays in this position until its head 16 comes into contact, via its engagement ramp 21, with the guide pin 8.

In opening the lid further, the head of the catch finally hooks onto the pin 8, being pulled back against the latter by the torque created by the force $F_2$ of restraint of the torsion bars.

In this regard it must be pointed out that the catch 15 always tends to pivot in the same direction, since in the course of opening the lid the forces exerted by restraint of the torsion bar always intersect the line 22 between the axes of the link 6 from the same side.

The hooking of the catch is enabled by a small amount of play between the projection 19 and the end of the slot 20, which permits maintaining the head 16 of the catch pressed against the guide pin 8 by the action of the force $F_2$.

The resultant hooking assures full opening of the lid and holding it there in a reliable manner.

The presence of the holding catch permits a significant decrease in the torsion torques necessary for equilibrating the lid, because of the fact that its being held in the completely open position is no longer assured only by the torsion bars, the solution of the aforementioned prior patent. The opening of the lid consequently takes less effort and is smoother.

Also, the precise and reliable latching of the open lid eliminates the sag of the torsion bar so as to gain 3 to 5 degrees in the angle of the open lid.

In order to limit the play between the head 16 of the catch, the guide pin 8 and the slot 5 in the gooseneck, the latter exhibits a slight taper 23 at its end to assure firm contact with the pin 8 at the end of travel.

To close the lid, it is merely pushed downward. The force transmitted by the gooseneck 4 to the catch 15 frees the latter in making it pivot in the reverse direction, for unlatching, due to the reaction of the pin 8.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for the articulation of movable panels, particularly automobile trunk lids, comprising:

a first link having a gooseneck;

a torsion bar acting upon said link;

a second link having a longitudinal axis and being pivotable about an axis integral with a fixed part of the trunk and being articulated with said first link;

an elongated slot, located on said first link, and acting as a cam to engage a guide pin integral with the fixed part of the trunk; and a catch, subjected to a torque by said torsion bar, mounted so as to pivot about the axis of articulation between said first and second links, and having a head latchable with said guide pin when the lid is in the fully open position, said catch including on its upper edge, a recess in the form of a second cam with which said torsion bar is engageable, and the profile of which is such that the force exerted by said torsion bar on said catch always acts from the same side across the line between the axes of said second link in the course of opening said lid.

2. The apparatus of claim 1, wherein a rearward extension of said recess defines a cavity which is deeper than the recess so as to completely enclose one end of said torsion bar when the lid is open.

3. The apparatus of claim 1, wherein the pivoting of the catch is limited by a projection situated between its articulation and its head, said projection engaging a slot in the first link concentric with the articulation.

* * * * *